US009504314B2

(12) United States Patent
Leng

(10) Patent No.: US 9,504,314 B2
(45) Date of Patent: Nov. 29, 2016

(54) FOLDING ROUND TABLE

(71) Applicant: Luhao Leng, Fujian (CN)

(72) Inventor: Luhao Leng, Fujian (CN)

(73) Assignee: NEW-TEC INTEGRATION (XIAMEN) CO., LTD., Xiamen (CN)

( * ) Notice: Subject to any disclaimer, the term of this patent is extended or adjusted under 35 U.S.C. 154(b) by 0 days.

(21) Appl. No.: 14/784,222

(22) PCT Filed: Apr. 10, 2014

(86) PCT No.: PCT/CN2014/075067

§ 371 (c)(1),
(2) Date: Oct. 13, 2015

(87) PCT Pub. No.: WO2014/166408

PCT Pub. Date: Oct. 16, 2014

(65) Prior Publication Data

US 2016/0066684 A1 Mar. 10, 2016

(30) Foreign Application Priority Data

Apr. 11, 2013 (CN) ..... 2013 1 0126122

(51) Int. Cl.

| | |
|---|---|
| ***A47B 3/00*** | (2006.01) |
| ***A47B 3/087*** | (2006.01) |
| ***A47B 3/091*** | (2006.01) |
| ***A47B 13/00*** | (2006.01) |
| ***A47B 13/08*** | (2006.01) |
| *A47B 3/08* | (2006.01) |

(52) U.S. Cl.

CPC ..... *A47B 3/087* (2013.01); *A47B 3/0916* (2013.01); *A47B 13/003* (2013.01); *A47B 13/083* (2013.01); *A47B 2003/0824* (2013.01); *A47B 2013/006* (2013.01)

(58) Field of Classification Search

CPC .. A47B 3/087; A47B 13/003; A47B 13/083; A47B 2013/006; A47B 2003/0824

USPC ..... 108/167, 166, 168, 169, 171, 174, 127

See application file for complete search history.

(56) References Cited

U.S. PATENT DOCUMENTS

| | | | | | |
|---|---|---|---|---|---|
| 1,780,394 | A * | 11/1930 | Kalgren | ..... | A47B 3/0912 108/125 |
| 1,872,669 | A * | 8/1932 | Burlin | ..... | A47B 3/083 108/127 |
| 2,024,431 | A * | 12/1935 | Corduan | ..... | A47B 3/0916 108/127 |

(Continued)

FOREIGN PATENT DOCUMENTS

| | | | |
|---|---|---|---|
| CN | 101541208 | A | 9/2009 |
| CN | 103239011 | A | 8/2013 |

(Continued)

*Primary Examiner* — Jose V Chen
(74) *Attorney, Agent, or Firm* — Rabin & Berdo, P.C.

(57) ABSTRACT

Disclosed is a folding table including two table tops, a first and second support components and four table legs. The two table tops are joined at a folding line with a middle point. The support components support the table tops, each of which has a border and two connecting arms. The border is connected to an outer edge of the table tops. One end of the connecting arm is connected to the border, and the other end of the connecting arm has a hinge part. The hinge part of the connecting arm of the first support component joins that of the respective connecting arm of the second support component. One end of the table leg is hinged to the border. The other ends of the table legs meet at the middle point in the folded state.

12 Claims, 7 Drawing Sheets

(56) References Cited

U.S. PATENT DOCUMENTS

| | | | | | |
|---|---|---|---|---|---|
| 2,529,940 | A * | 11/1950 | Higley | A47B 3/0917 | 108/127 |
| 2,845,316 | A * | 7/1958 | Bailey | A47B 3/08 | 108/127 |
| 2,934,386 | A * | 4/1960 | Shore | A47B 3/087 | 108/35 |
| 3,049,387 | A * | 8/1962 | Schlegel | A47B 3/087 | 108/127 |
| 4,043,277 | A | 8/1977 | Wallace | | |
| 5,367,962 | A * | 11/1994 | Tseng | A47B 3/0812 | 108/127 |
| 6,508,184 | B1 * | 1/2003 | Winter | A47B 13/021 | 108/125 |
| 6,651,568 | B1 * | 11/2003 | Buono | A47B 3/0915 | 108/127 |
| 7,707,948 | B2 * | 5/2010 | Lin | A47B 3/08 | 108/115 |
| 7,707,949 | B2 * | 5/2010 | Larcom | 108/132 | |
| 8,573,139 | B2 * | 11/2013 | Ashby | A47B 3/087 | 108/126 |
| 2004/0112263 | A1 * | 6/2004 | Zheng | A47B 3/0818 | 108/127 |
| 2008/0072804 | A1 * | 3/2008 | Lin | A47B 3/08 | 108/127 |

FOREIGN PATENT DOCUMENTS

| | | | |
|---|---|---|---|
| CN | 203152913 | U | 8/2013 |
| GB | 744192 | A | 2/1956 |

* cited by examiner

FOLDING ROUND TABLE

FIELD OF THE INVENTION

The present invention relates to a folding round table, especially to a round table with a plastic compositing table top.

BACKGROUND OF THE INVENTION

Tables are important daily used furniture, people use tables in house and office. A folding table has the table legs folded during transportation or unused, so that it can reduce the space it needs, and when to use the table, it just needs to pull out the table legs, so that it is very convenient. However, the folded table still has large area after the table legs are folded, the table is also heavy that it is uneasy to transport and move.

SUMMARY OF THE INVENTION

The present invention is provided with a folding round table that it overcomes the disadvantages of the existing known technology. The technical proposal of the present invention is that:

A folding round table, comprising two table tops, two support components and four table legs, wherein the support component comprises a border and two connecting arms, the border has the shape corresponding to the shape of the outer edge of the table top, the border is connected to the outer edge of the table top, one end of the connecting arm is connected to the border, the other end of the connecting arm is disposed with a hinge, two connecting arms are arranged symmetrically about the center of the border, the hinges of the connecting arms of one tablet top is hinged joint to the hinges of the connecting arms of the other table top, two table tops can be folded and connected; the table legs are disposed to the support components, four table legs are arranged in a cross after folded.

In another preferred embodiment, each table leg comprises a leg pipe and a pivot pipe, the top portion of the leg pipe is connected to the central portion of the pivot pipe, one end of the pivot pipe is hinged joint to the border, the other end of the pivot pipe is hinged joint to the connecting arm.

In another preferred embodiment, the table leg further comprises a reinforcing pipe with one end connected to the leg pipe and the other end connected to the pivot pipe. In another preferred embodiment, the connecting arm comprises an incline section and a vertical section that re connected together, the free end of the incline section is connected to the border, the hinge is connected to the free end of the vertical end, the other end of the pivot pipe is hinged joint to the incline section.

In another preferred embodiment, the border is disposed with a hinge set, the incline section is disposed with a hinge set, two ends of the pivot pipe are respectively hinged joint to the two hinge sets.

In another preferred embodiment, it further comprises four elastic pieces, one end of the elastic piece is hinged joint to the incline section, the central portion of the elastic piece is disposed with a slide groove along the length direction, the leg pipe is disposed with a river, the river is inserted to the slide groove.

In another preferred embodiment, the support set further comprises a reinforcing cross bar with one end connected to the border and the other end connected to the inner edge of the bottom surface of the table top.

In another preferred embodiment, the table top comprises a panel, a bottom plate and a built-in part, the panel covers the bottom plate and forming a chamber, the chamber is disposed along the edge of the table top, the built-in part is embedded in the chamber; the border, the other end of the connecting arm, the other end of the reinforcing cross bar are locked to the built-in part.

In another preferred embodiment, the top surface of the panel is disposed with a groove, the groove is disposed close to the inner edge of the table top and is adjacent to the built-in part.

In another preferred embodiment, at the outer edge of the panel, the top surface of the panel and the side are connected in transition way.

Compared to the existing known technology, the technical proposal of the present invention has advantages:

1. The table legs are hinged joint to the support components, four table legs are arranged in a cross after folded, so that it, on one hand, reduces the space the folding round table needs, on another hand, it can maximally lengthen the table legs; two hinges of one support component are respectively hinged joint to two hinges of the other support component, so that the two table tops can be folded, thus reducing the space the table needs, and it is also more easy to transport and move.

2. one end of the pivot pipe is hinged joint to the border, while the other end is hinged joint to the connecting arm, so that the table legs can be stably hinged joint to the support components.

3. one end of the reinforcing pipe is connected to the leg pipe, while the other end is connected to the pivot pipe, thus enhancing the strength of the table legs.

4. the connecting arms can improve the bearing performance of the table tops, thus making the folding round table more stable.

5. the leg pipe is disposed with a rivet, the rivet is inserted to the slide groove of the elastic piece, so that it can avoid the table leg shaking.

6. one end of the reinforcing cross bar is connected to the border, while the other end is connected to the inner edge of the bottom surface of the table top, so that it further enhances the strength of the table.

7. the border, the connecting arm, the reinforcing cross bar are locked to the built-in element that it also enhances the strength of the table.

8. the top surface of the panel is disposed with a groove, the groove is benefit for the suction molding of the panel, so that it can improve the flatness of the panel.

9. The top surface and the side of the panel are connected in transition way by an incline surface, the incline surface is also benefit for the suction molding of the panel, it can ensure the evenly thickness of the panel at the edge.

BRIEF DESCRIPTION OF THE DRAWINGS

The present invention will be further described with the drawings and the embodiments.

DETAILED DESCRIPTION OF THE EMBODIMENT

Figure 1:
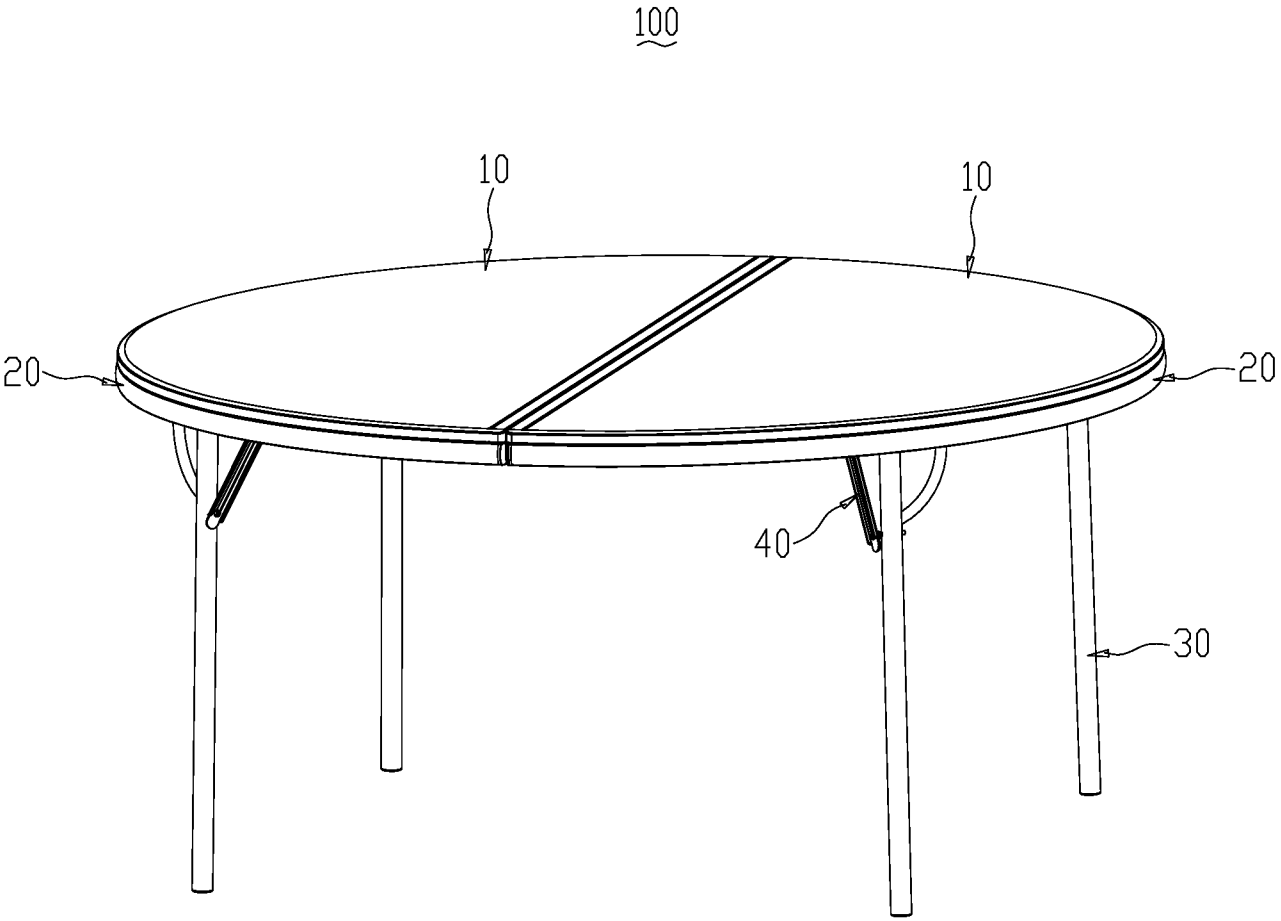
FIG. 1 illustrates a schematic diagram of the folding round table of the present invention.
Figure 2:
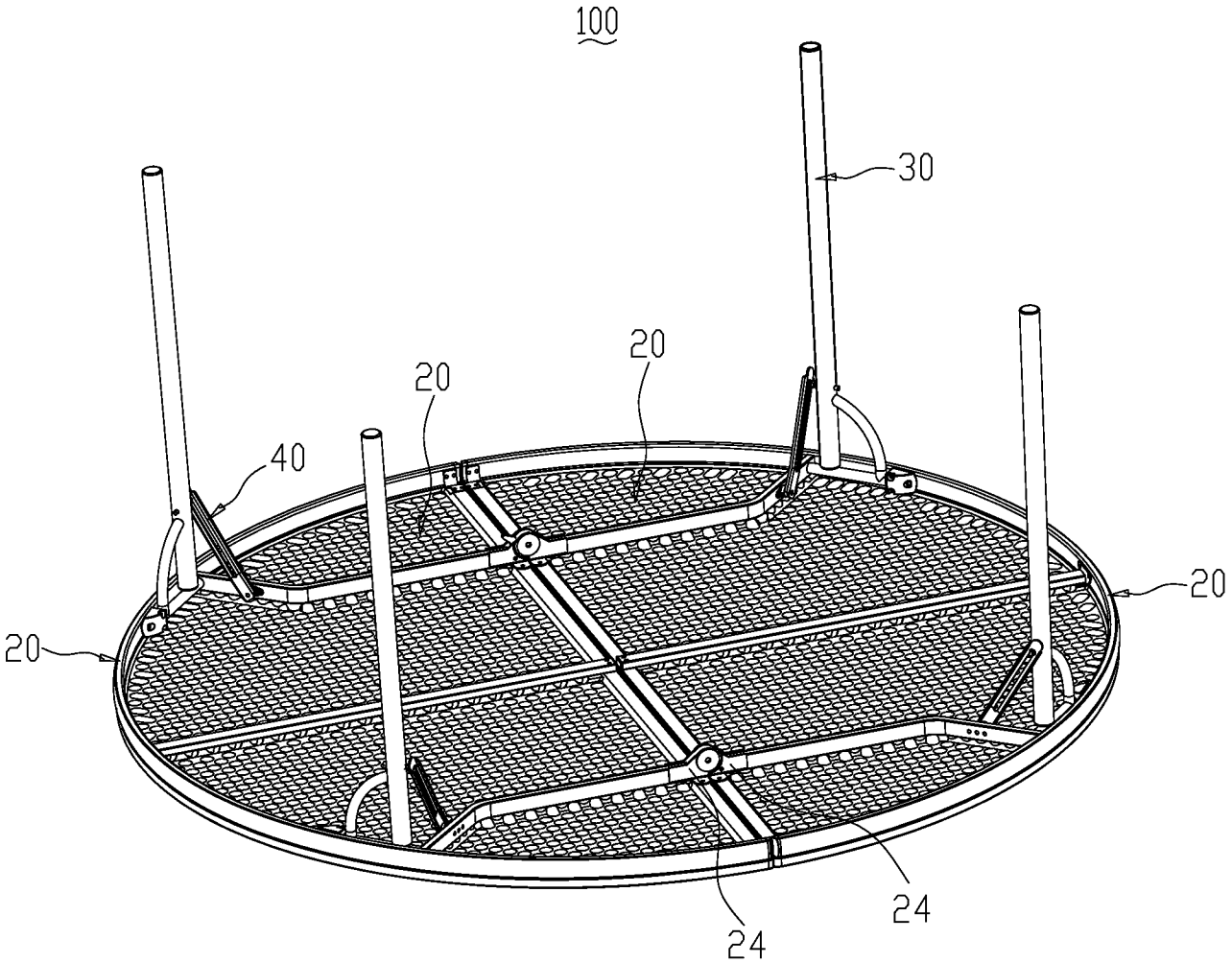
FIG. 2 illustrates a second schematic diagram of the folding round table of FIG. 1.

Please referring to FIG. 1 and FIG. 2, a folding round table 100 of the present invention comprises two table tops 10, two support components 20, four table legs 30 and four elastic pieces 40. Two table tops 10 are respectively fixedly connected to the two support components 20. Two support components 20 are used to support the two table tops 10 and to make the two table tops 10 folded and pivoted joint together. Four table legs 30 are used to support the two support components 20. Four elastic pieces 40 are used to make the four table legs 30 unfolded stably.

Figure 3:
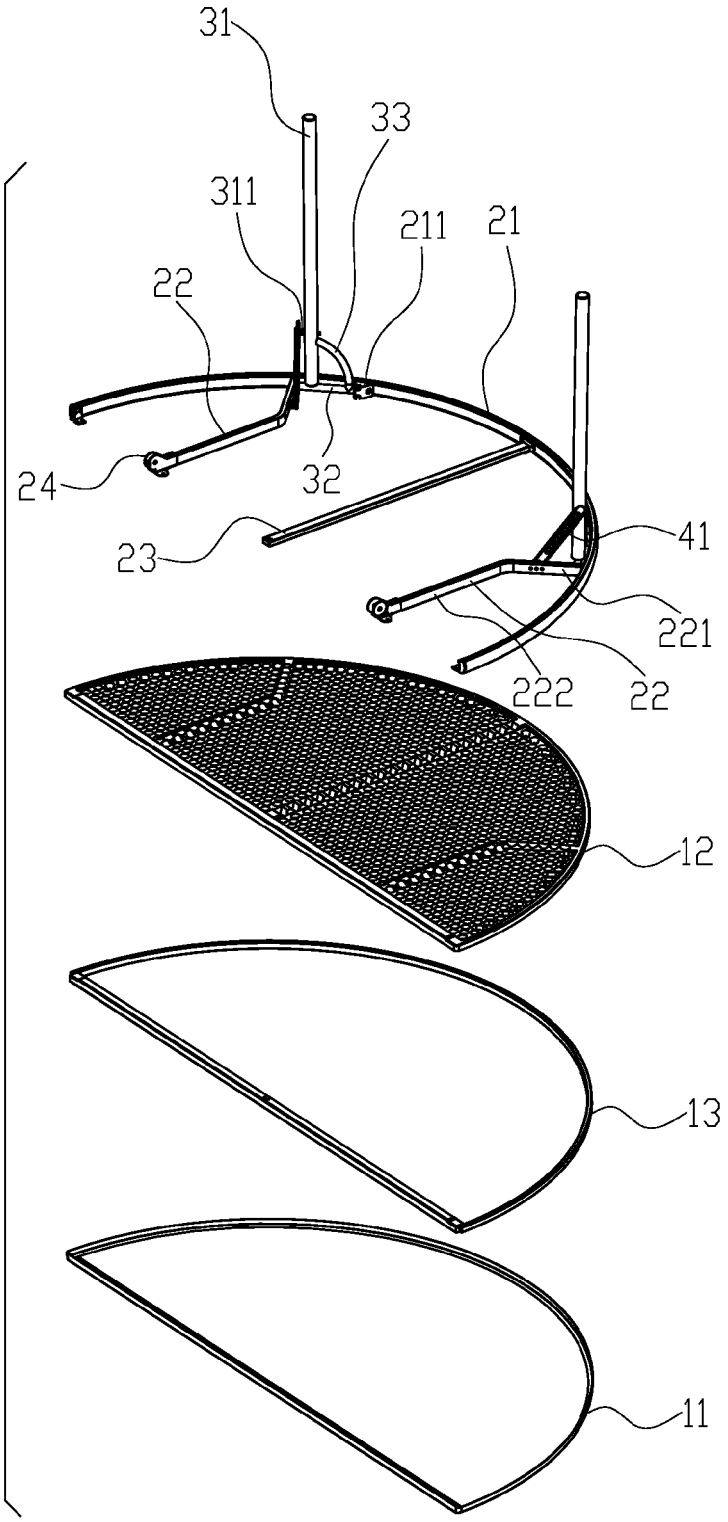
FIG. 3 illustrates a partial exploded and schematic diagram of the folding round table of FIG. 1.
Figure 4:
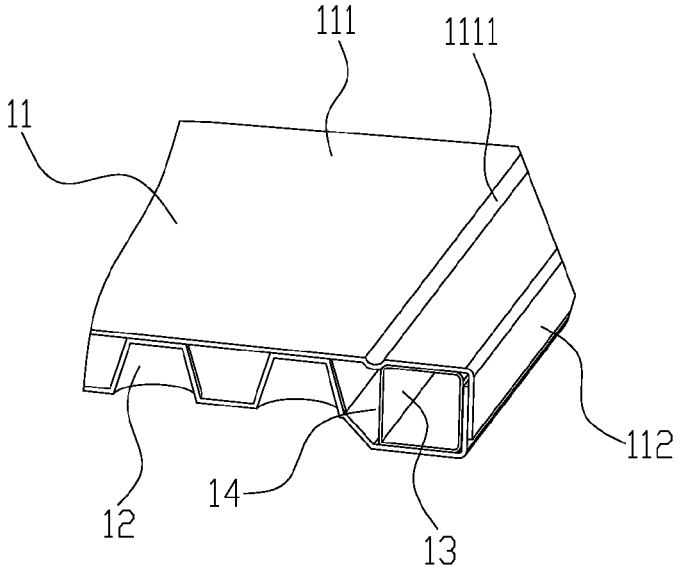
FIG. 4 illustrates a partial section diagram of the folding round table of FIG. 1.
Figure 5:
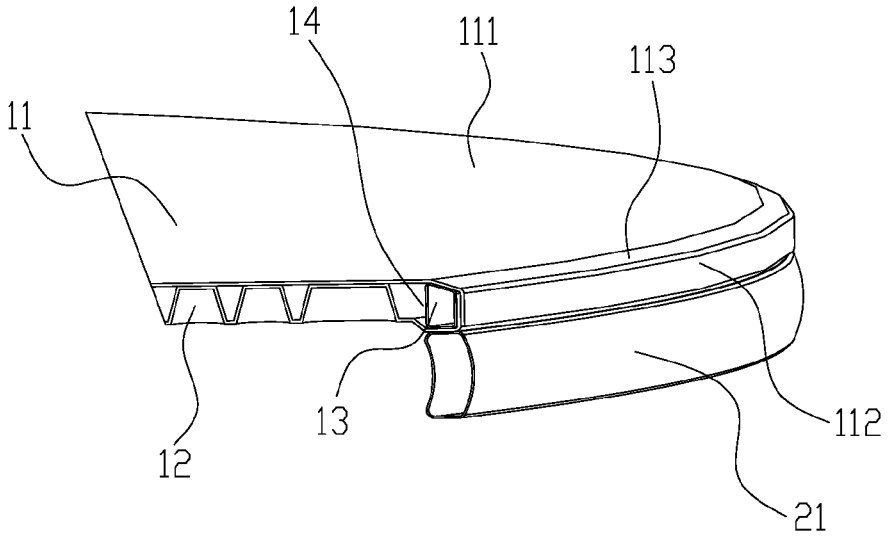
FIG. 5 illustrates a second partial section diagram of the folding round table of FIG. 1.

Referring to FIG. 3, FIG. 4, FIG. 5, the table top 10 is semi-circle shaped. The outer edge of the table top 10 is semi-circle shaped, the inner edge of the table top 10 is straight line shaped. The table top 10 comprises a panel 11, a bottom plate 12 and a built-in element 13. The panel and the bottom plate 12 are molded from plastic material. The panel 11 comprises a top surface 111 and a side 112. At the outer edge of the panel 11, the top surface 111 and the side 112 are connected in transition way by an incline surface 113. The top surface 111 of the panel 11 is disposed with an elongated groove 1111 along the inner edge, the groove 1111 is disposed close the inner edge of the panel 11. The panel 11 covers the bottom plate 12 and forming a chamber 14, the chamber 14 is disposed along the edge of the table top. The built-in element 13 is made of metal material. The built-in element is embedded in the chamber 14, the groove 1111 is adjacent to the built-in element 13. The built-in element is a semi-circle shaped border having an arc portion and a straight portion. The support component 20 is made of metal material, it comprises a border 21, two connecting arms 22 and a reinforcing cross bar 23. The border 21 has its shape corresponding to the shape of the outer edge of the table top 10, so that it is also semi-circle shaped, and the border 21 is connected to the built-in element 13 of the table top 10 in detachable way. One end of the reinforcing cross bar 23 is connected to the center of the border 21, while the other end extends to the circle center of the table top 10 and is connected to the straight portion of the built-in element 13. Two connecting arms 22 are arranged symmetrically about the center of the border 21. The connecting arm 22 comprises an incline section 221 and a straight section 222 that are connecting together. The free end of the incline section 221 is connected to the border 21. The free end of the straight section 222 is disposed with a hinge 24. The table leg 30 comprises a table pipe 31, a pivot pipe 32 and a reinforcing pipe 33. The leg pipe 31 is disposed with a rivet 311. The top portion of the leg pipe 31 is connected to the central portion of the pivot pipe 32. The reinforcing pipe 33 is arc shaped with one end connected to the leg pipe 31 and the other end connected to the pivot pipe 32.

The central portion of the elastic piece 40 is disposed with a slide groove 41 along the length direction.

Referring to FIG. 2 and FIG. 3, one end of the pivot pipe 32 is hinged joint to the border 21, while the other end is hinged joint to the incline section 221 of the connecting arm 22. Preferred, the border 21 can be disposed with a hinge set 211, the incline section 221 is also disposed with a hinge set, two ends of the pivot pipe 32 are respectively hinged joint to the two hinge sets. One end of the elastic piece 40 is hinged joint to the incline section 221, the rivet 311 is inserted to the slide groove 41. the border 21 is connected to the outer edge of the bottom surface of the table top 10, two end portions of the border 21, the free end of the straight section 222, the other end of the reinforcing cross bar 23 are locked to the built-in element 13. The hinge 23 is disposed at the inner edge of the table top 10. Therein, two hinges 24 of one support component 20 are hinged joint to the two hinges 24 of the other support component 20.

Figure 6:
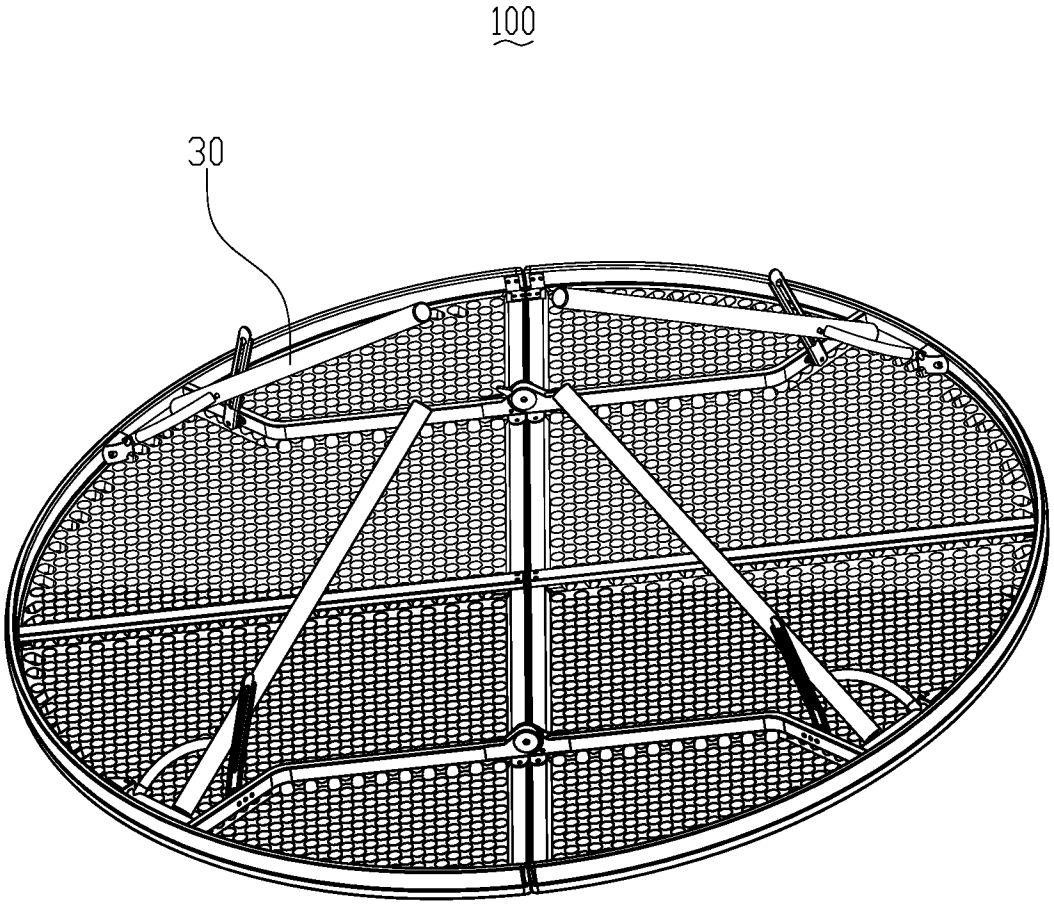
FIG. 6 illustrates a schematic diagram of the folding round table of FIG. 1 when the table legs are being folded.
Figure 7:
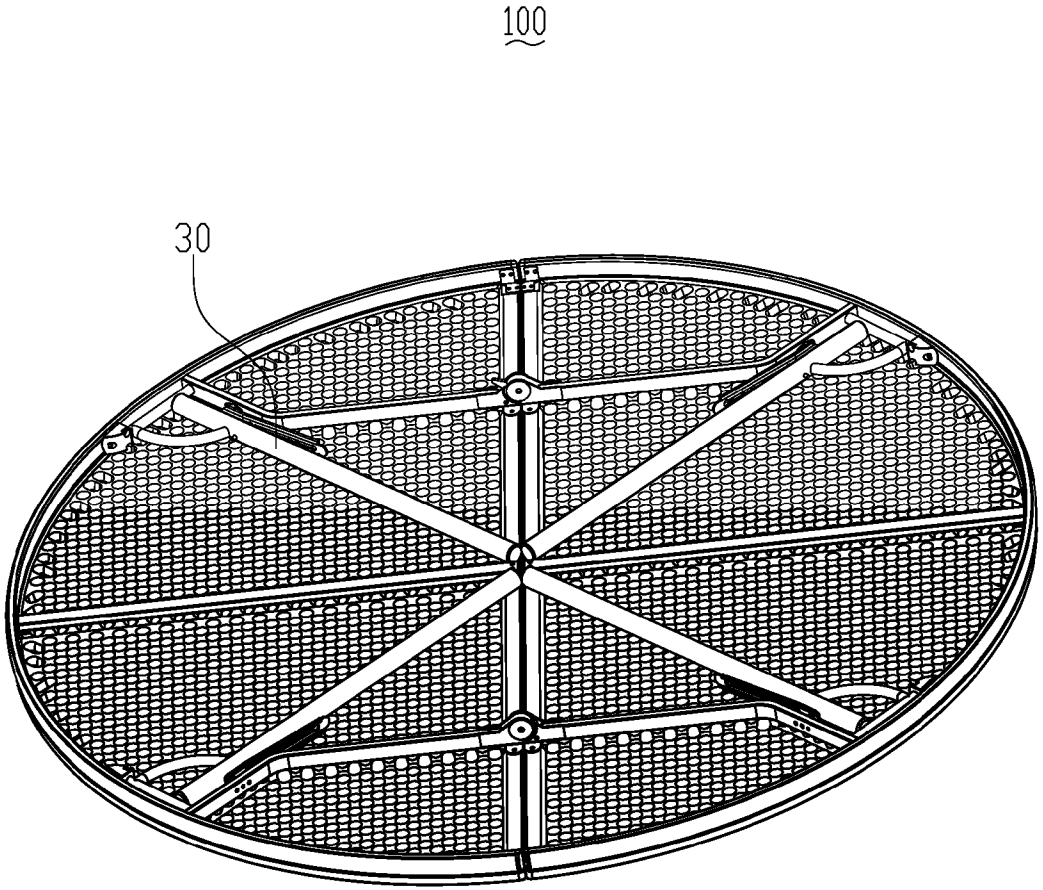
FIG. 7 illustrates a schematic diagram of the folding round table of FIG. 1 when the table legs are fully folded.

As figured in FIG. 6 and FIG. 7, when folding the table, four table legs 30 are folded firstly, the four table legs 30 are arranged in a cross after folded.

Figure 8:
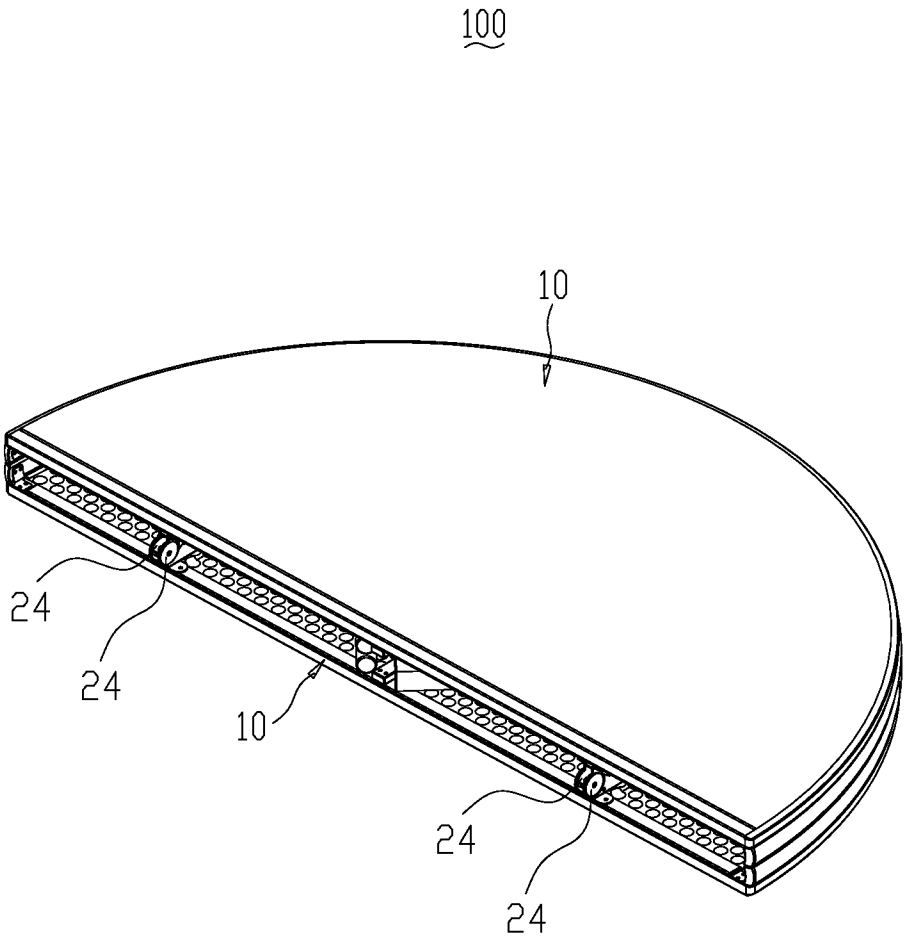
FIG. 8 illustrates a schematic diagram of the folding round table of FIG. 1 when two table tops are folded.

As figured in FIG. 8, with the hinges 24, two table tops 10 can be folded that it can reduce the space the folding round table 100 needs.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The present invention is provided with a folding round table that the table tops and the table legs are foldable, it is used with convenience, and as it has a plastic table top, the table has light weight and well structure strength.

The invention claimed is:

1. A folding table, comprising:

two table tops joined at a folding line, the folding line having a middle point, the two table tops being symmetrical about the folding line and having an outer edge;

a first support component and a second support component supporting the table tops, each of the first support component and the second support component having a border and two connecting arms, the border being connected to the outer edge of the table tops, each of the two connecting arms having a first end and a second end, the first end of each of the connecting arms being connected to the border and the second end of each of the connecting arms having a hinge part, the hinge parts of the first support component joining the hinge parts of the second support component to form two hinges at the folding line; and four table legs, each of the table legs having a first end and a second end, the first end of each of the table legs hinged to the border to enable the table legs to transition between a folded state and an unfolded state, the second ends of the table legs meeting at the middle point in the folded state so that the four table legs are arranged in a cross shape.

2. The folding table according to claim 1, wherein the folding table has a round shape, and the table tops have a semi-circular shape.

3. The folding table according to claim 1, wherein the border has a shape corresponding to a shape of the outer edge.

4. The folding table according to claim 1, wherein each of the table legs comprises a leg pipe and a pivot pipe having two ends, the pivot pipe connects perpendicularly to the leg pipe, one end of the pivot pipe is hingedly connected to the border, and the other end of the pivot pipe hingedly connected to a respective connecting arm.

5. The folding table according to claim 4, wherein each of the table legs further comprises a reinforcing pipe connecting the leg pipe and the pivot pipe.

6. The folding table according to claim 4, wherein each of the connecting arms comprises an incline section at the first end, and a straight section extending from the incline section.

7. The folding table according to claim 6, wherein the incline section joins the border to form a first hinge set, the border comprises a second hinge set, and the pivot pipe pivotally joins the border between the first hinge set and the second hinge set.

8. The folding table according to claim 6, further comprising an elastic piece, the elastic piece pivotally joining the incline section of one of the connecting arms, the elastic piece having a slide groove along a longitudinal direction, the slide groove receiving a rivet provided on a corresponding leg pipe.

9. The folding table according to claim 1, wherein each of the first support component and the second support component further comprises a reinforcing cross bar.

10. The folding table according to claim 9, wherein each of the table tops comprises a panel, a bottom plate and a built-in part, the panel covers the bottom plate to form a chamber for accommodating the built-in part.

11. The folding table according to claim 10, wherein the panel comprises a top surface, a side, and an inclined edge connected between the top surface and the side.

12. The folding table according to claim 11, wherein the top surface is provided with a groove close to the inclined edge.

* * * * *